United States Patent [19]

Sweatt, III et al.

[11] Patent Number: 4,801,077

[45] Date of Patent: Jan. 31, 1989

[54] COMBINED TRAY AND COVER FOR USE IN THE DELIVERY OF FOOD ITEMS

[75] Inventors: Blaine Sweatt, III, Minneapolis; Stephen E. Moorman, Forest Lake, both of Minn.

[73] Assignee: General Mills, Inc., Minneapolis, Minn.

[21] Appl. No.: 145,169

[22] Filed: Jan. 19, 1988

[51] Int. Cl.[4] ..... B65D 43/03; B65D 43/04

[52] U.S. Cl. ..... 229/113; 220/405; 229/52 B; 229/125.19; 229/125.32; 229/906; 426/124; 426/128

[58] Field of Search ..... 229/113, 114, 125.02, 229/125.19, 125.32, 178, 902, 906, 23 R, 23 BT, 52 B, DIG. 2, 125.26, 125.27, 125.28; 220/403, 405, 462, 463, 470; 426/124, 128

[56] References Cited

U.S. PATENT DOCUMENTS

| | | | |
|---|---|---|---|
| 1,612,166 | 12/1926 | Baldwin | 229/125.32 |
| 1,927,435 | 9/1933 | Derst | 426/128 |
| 1,939,342 | 12/1933 | Edwards | 426/128 |
| 2,116,513 | 5/1938 | Frankenstein | 229/178 |
| 2,707,587 | 5/1955 | Wittstein | 229/178 |
| 2,741,414 | 4/1956 | Nottage | 206/591 |
| 2,829,459 | 4/1958 | Halpern | 426/128 |
| 2,944,717 | 7/1960 | Lynch | 229/23 R |
| 3,003,676 | 10/1961 | DeNola | 229/DIG. 2 |
| 3,012,691 | 12/1961 | Gross et al. | 220/405 |
| 3,027,062 | 3/1962 | Huss et al. | 229/114 |
| 3,425,543 | 2/1969 | Harvey | 229/52 B |
| 3,477,680 | 11/1969 | Fliger, Jr. | 426/128 |
| 3,951,329 | 4/1976 | Turner | 229/125.31 |
| 4,133,430 | 1/1979 | Cravens | 229/178 |
| 4,197,940 | 4/1980 | DeRossett | 426/128 |
| 4,441,626 | 4/1984 | Hall | 426/128 |
| 4,723,700 | 2/1988 | Wischusen, III | 229/902 |
| 4,753,831 | 6/1988 | Hosoyamoda et al. | 229/915 |

FOREIGN PATENT DOCUMENTS

| | | | |
|---|---|---|---|
| 1437637 | 3/1966 | France | 229/52 B |
| 2344468 | 10/1977 | France | 229/125.28 |
| 640589 | 5/1962 | Italy | 229/23 BT |

*Primary Examiner*—Stephen Marcus
*Assistant Examiner*—Gary E. Elkins
*Attorney, Agent, or Firm*—L. MeRoy Lillehaugen; John A. O'Toole; Stuart R. Peterson

[57] ABSTRACT

The carton is comprised of a corrugated paperboard tray and a corrugated paperboard cover. The tray has upstanding side wall panels and upstanding end wall panels, the upstanding end wall panels having hand holes for lifting the tray. The cover has a top panel provided with a non-slip surface, trapezoidally configured side wall panels and trapezoidally configured end wall panels. Each of the side wall panels and the end wall panels of the cover are hingedly connected to the top panel by reason of weakened fold lines. The corrugations of the cover extend at right angles to the fold lines for the cover's end wall panels so as to provide a greater degree of deflective resistance to the cover's end wall panels then that imparted to the cover's side wall panels with the consequence that the end wall panels of the cover exert a greater amount of pressure against the end wall panels of the tray than that exerted by the cover's side wall panels. However, the end wall panels of the cover are dimensioned so as to fit within the side wall panels of the cover and thus exert a pressural action against the side wall panels of the cover, thereby increasing the amount of frictional retention force of the side wall panels of the cover against the side wall panels of the tray than would otherwise occur. A paper mat or doily has a non-slip upper surface. Containers can be dimensioned so as to engage both non-slip surfaces.

12 Claims, 3 Drawing Sheets

COMBINED TRAY AND COVER FOR USE IN THE DELIVERY OF FOOD ITEMS

BACKGROUND OF THE INVENTION

This invention relates generally to paperboard cartons, and pertains more particularly to a combined tray and cover that will find especial utility in the home delivery of food items that have been pre-ordered by telephone.

In recent times a considerable amount of effort has gone into the devising of cartons comprised of a tray and cover that are suitable for home delivery of food products with the thought in mind that the carton can be discarded once the contents have been consumed. Examples of such cartons are disclosed in U.S. Pat. Nos. 3,632,265 granted on Dec. 7, 1982 to Donald L. Williams for "Container," and 4,660,716 granted to Michael J. McMahon for "Packaging Arrangement for Preparing and Serving Food Products." While U.S. Pat. No. 4,362,265 makes use of flat paperboard blanks in forming the duplicate trays that when fitted together constitute a carton, the trays require glueing and require that they be stored in a three-dimensional form. U.S. Pat. No. 4,660,716 discloses a package that is also preformed, having various cavities for the reception of the food items. As with the container of U.S. Pat. No. 4,362,265, the three-dimensional shape takes up considerable space which is a distinct disadvantage.

SUMMARY OF THE INVENTION

An object of the present invention is to provide a combined tray and cover that will enable food items to be delivered from a central location where the food is prepared to the place where the food is to be consumed. More specifically, the invention has for an aim the fabricating of a tray and cover that will be sufficiently sturdy so as to withstand normal handling during transit, or even rough handling, without damage to the food items, and to provide a cover for the tray that can be quickly interfitted with the tray after the desired food items have been placed on the tray in preparation for delivery to a home, condominium, apartment or office. It is intended that the cover not only be rapidly engaged with the tray, but equally easily removed from the tray at the location where the food is to be consumed.

Another object of the invention is to provide a combined tray and cover that when the cover is interfitted with the tray the resulting carton becomes sufficiently rigid to permit the stacking and carrying of several cartons, one on top of the other. Not only can the cartons be stacked on top of each other in the delivery truck, but this feature normally enables the driver of the truck to make only one walking trip between the truck and the dwelling when delivering several cartons to a single address.

An important further object of the invention is to supply the individual trays and covers in a flat and unassembled form so that they can be compactly shipped and compactly stored until needed, yet quickly assembled from the flat stock into a three-dimensional shape at the very moment that the food is to leave the food-preparing establishment destine for the customer who has phoned in the order.

Another object of the invention is to provide a combined tray and cover where the combination can be readily picked up and handled. In this regard, it is planned that each end of the tray be provided with integral paperboard handles that extend substantially vertical, with the adjacent walls of the cover sloping away from the handles, thereby enabling the delivery person to easily insert his or her fingers through the handle openings in order to firmly grasp a single tray or the underlying tray of a number of trays and covers that have been vertically stacked on top of each other.

The invention has as an additional object the use of a paper mat or doily having a non-slip upper surface so that the containers placed within the combined tray and cover will not likely be to slide around inside the unit. It is also within the purview of the invention to provide similar surface on the underside of the cover, thereby further anchoring the containers when of such height that the tops thereof engage the cover's underside.

A still additional object resides in providing a combined tray and cover that will be aesthetically pleasing when the two are assembled together. Thus, the resulting carton not only possesses a considerable amount of utility and versatility, but is also attractive in appearance.

Still further, an object of the invention is to provide a tray and cover that will be sufficiently inexpensive so that the combination can be discarded once the food has been consumed. It is also within the purview of the invention to have both the tray and cover, being of paperboard, completely biodegradable.

Yet another object of the invention is to employ paperboard material that, while sufficiently rigid so as to form a three-dimensional carton when the cover is assembled with the tray, is of sufficient thickness so as to provide a considerable amount of thermal insulation. Consequently, the food being transported may very well retain enough heat so that it will not require reheating, depending of course on the distance and time it takes to complete the delivery. Nonetheless, the paperboard stock permits the tray and cover to be placed in a conventional oven with the oven being preheated to a normal temperature, or in the alternative placed in a microwave oven for reheating.

Briefly, the invention contemplates a carton formed from two paperboard blanks, both of which can be easily shaped into a three-dimensional form at the time the food leaves the establishment where it has been prepared. The tray is intended to be sufficiently sturdy when assembled so that the much simpler cover can be only frictionally interfitted with the tray yet remain in place during the delivery trip. Thus, while the tray has certain interlocking components, the cover is only a precut blank formed with side and end panels that can easily be pressed into the tray's cavity. In this regard, the tray, after being three-dimensionally formed from the flat blank, possesses upstanding side walls and end walls. The cover, however, has only hinged panels that can be readily flexed downwardly into the tray, there being a sufficient amount of deflective resistance so that enough frictional retention is developed to keep the cover in place.

DESCRIPTION OF THE PREFERRED EMBODIMENTS

Figure 1:
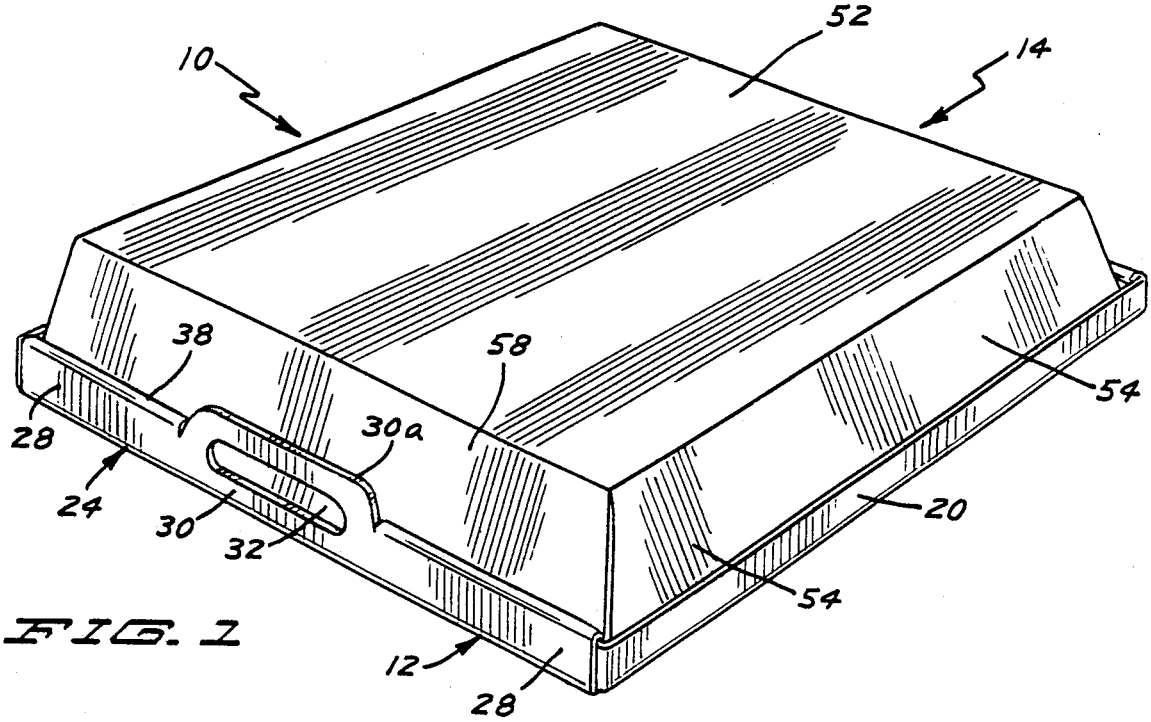
FIG. 1 is a perspective view of an assembled tray and cover exemplifying the invention.
Figure 2:
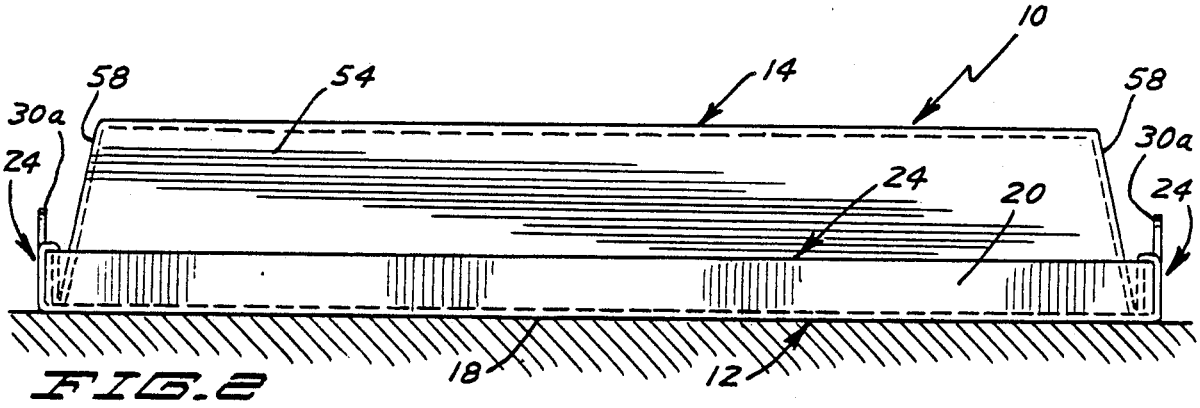
FIG. 2 is a side elevational view, such as when the carton of FIG. 1 is viewed from the right.

Reference should first be made to FIG. 1 where the assembled carton has been indicated generally by the reference numeral 10. The carton 10 comprises an underlying tray 12 and an overlying cover 14.

Figure 4:
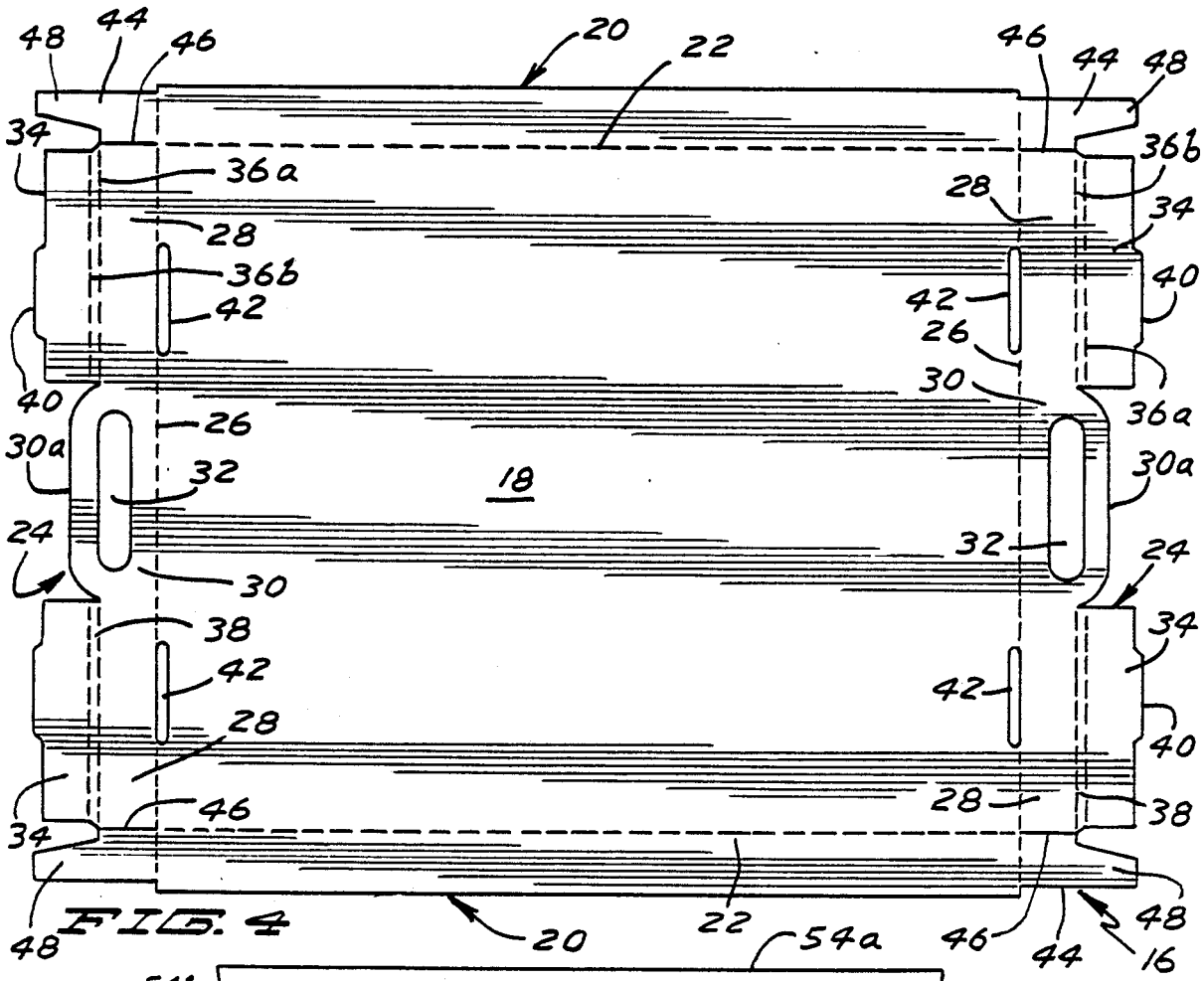
FIG. 4 is a top plan view of a corrugated paperboard blan from which the tray is formed.

The tray 12 is formed from a corrugated paperboard blank 16 appearing in FIG. 4. It will be well to describe the blank 16 by employing descriptive terms that will correspond to the tray 12 when assembled. Therefore, the blank 16 includes a bottom panel 18. The bottom panel 18 has side wall panels 20 that are hingedly connected thereto by weakened fold lines 22. Likewise, end wall panels 24 are hingedly connected to the bottom panel 18 by weakened fold lines 26. It will be helpful to assign additional reference numerals to portions of the end wall panels 24. Therefore, it will be noted that each end wall panel 24 includes wall portions 28, these wall portions 28 issuing in opposite directions from a central portion 30. Each central portion 30 has a hand hole 32 formed therein by reason of an integral bridging strip 30*a*.

Describing further the end wall panels 24, attention is directed to a pair of flap portions 34 which are hingedly connected to the wall portions 28 by means of double-fold lines 36*a* and 36*b*, the spacing between the fold lines 36*a* and 36*b* forming a bight or connecting strip portion 38 extending between each flap portion 34 and the particular wall portion 2 with which it is associated. Still further, there is an integral tab portion 40 on each of the flap portions 34, the tab portions 40 being dimensioned so as to be readily inserted into slots 42 formed in the bottom panel 18 adjacent the wall portions 28. The blank 16 additionally includes corner flaps 44, the corner flap 44 in each instance being formed by a die-cut line 46. Integral with each corner flap 44 is a locking finger 48.

It should be understood that the establishment providing the food to be delivered will normally store the various blanks 16 in a flat condition, the same condition in which they are shipped. Of course, a few blanks 16 can be three-dimensionally formed in order to provide a supply of trays 12 without waiting until the very moment trays are needed. The manner in which a tray 12 is formed from a blank 16 is quite simple and straightforward. All that the user need do is fold up the side wall panels 20, the weakened fold lines 22 readily allowing this to be done. Similarly, the end wall panels 24 are folded upwardly along the weakened fold lines 26. The wall portions 28 of the end wall panels 24, together with their bight portions or connecting strips 38, are then folded outwardly into a horizontal relationship. Thereafter, the wall portions 28 are flexed downwardly about the fold lines 36*b* so as to assume a parallel or confronting relationship with the wall portions 28. Virtually at the same time, the tab portions 40 are inserted into the slots 42. All that remains to be done at this stage is to then tuck in the locking fingers 48 belonging to the corner flaps 44, the fingers 48 being inserted between the outer surface of the wall portions 28 and the inner surfaces of the flap portions 34. The bights or strips 38 permit this to be easily accomplished.

Figure 5:
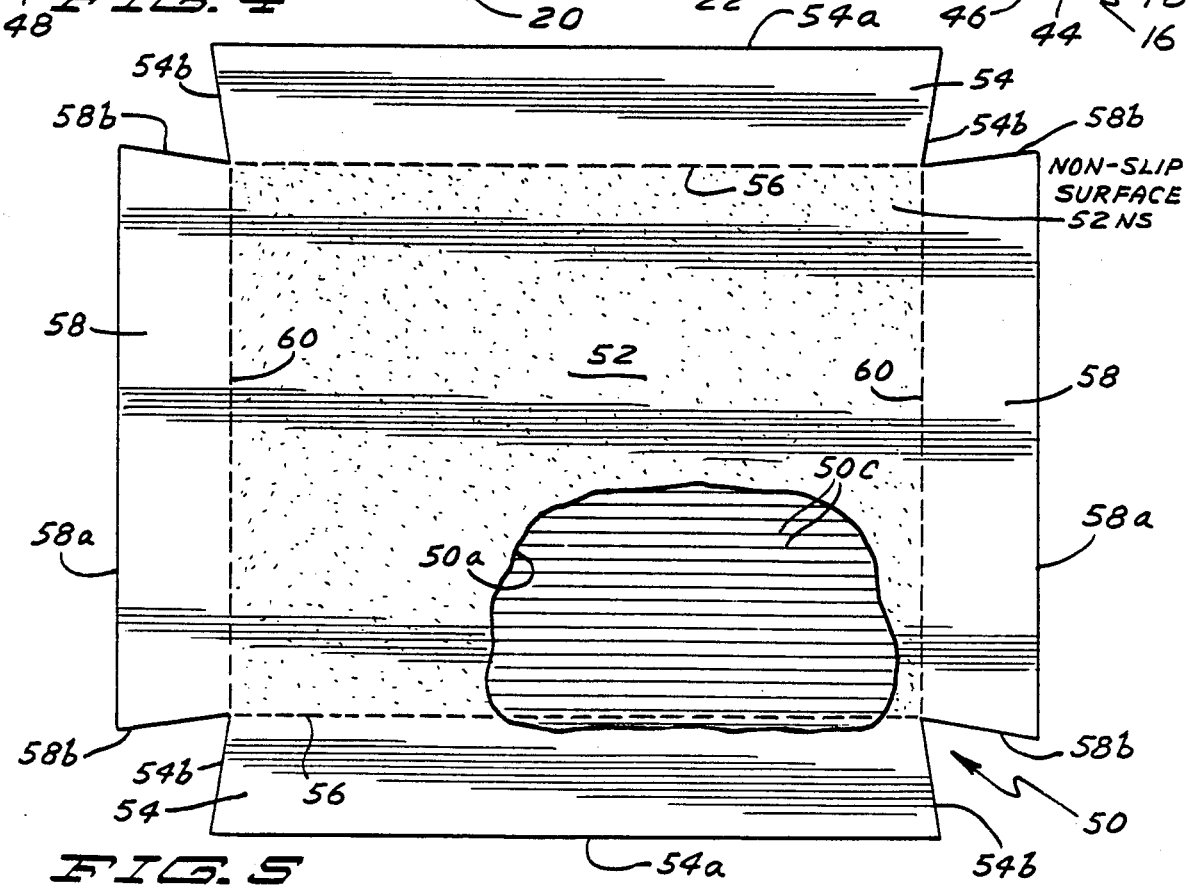
FIG. 5 is a top plan view of a corrugated paperboard blank from which the cover is formed, a portion of the upper paper layer in this instance having been removed so as to expose to view the direction in which the corrugations extend.

Describing now the cover 14, it will be recognized that the cover 14 is formed from a corrugated cardboard blank 5 that is illustrated in FIG. 5. Even though the blank 16 is of corrugated construction, the direction in which the corrugations extend in the blank 50 is quite important. Therefore, the blank 50 is fabricated with paper layers or laminations 50*a*, 50*b*, an intermediate paper layer sandwiched between the layers 50*a* and 50*b* forming longitudinally directed corrugations or flutes 50*c* that extend from the left end of the blank 50 to the right end thereof.

The blank 50 comprises a top panel 52 having a non-slip surface 52NS and trapezoidal side wall panels 54, the panels 54 being attached to the top panel 52 via weakened fold lines 56. The corrugations 50*c*, it will be understood from what has already been explained, extend parallel to the weakened fold lines 56. It should be observed that each panel 54, owing to its trapezoidal configuration, has a free edge 54*a* that extends parallel to its weakened fold line 56 plus end edges 54*b* that diverge slightly away from the opposite ends of the weakened fold lines 56 It is due to the divergence of the edges 54*b* that the panels 54 have the trapezoidal appearance that has been just referred to.

The blank 50 additionally includes end wall panels 58 that are hingedly connected to the panel 52 by weakened fold lines 60. Here again, the panels 58 possess a trapezoidal appearance by virtue of these panels 58 having a free edge 58*a* that extends parallel to the fold line 60 in each instance plus the end edges labelled 58*b* that diverge slightly from the fold line 60.

From FIG. 4 it can be readily discerned that the bottom panel 1 of the resulting tray 12 possesses a rectangular appearance. Corresponding dimensionally to the size of the bottom panel 18 is a paper mat or doily 62 having a non-slip upper surface 62NS. For a reason presently to be made manifest, dashed lines 64 are superimposed on FIG. 6 and dashed lines 66 are similarly superimposed on FIG. 7. The dashed lines 64 signify planes that extend upwardly in parallel relation from the ends of the tray 12. In other words, the length of the doily 62 corresponds to the distance between the planes represented by the dashed lines 64 and has a width corresponding to the distance between the planes represented by the dashed lines 66

Figure 3:
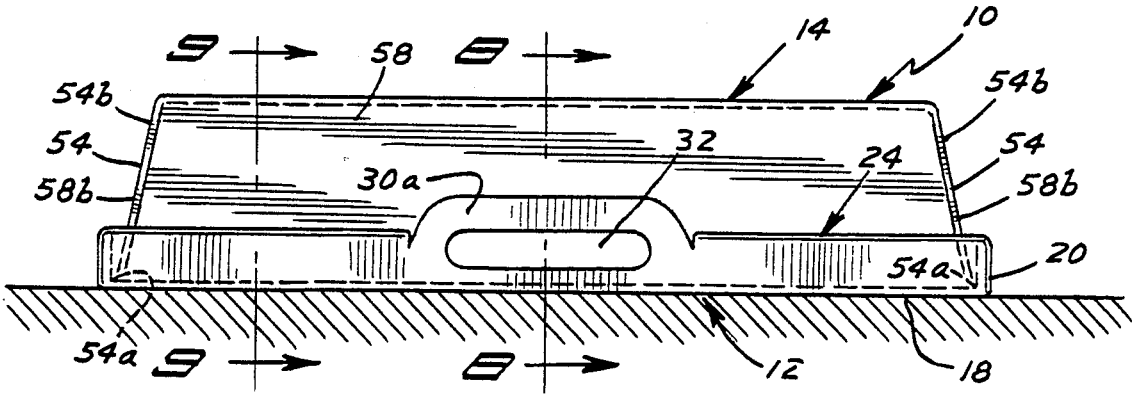
FIG. 3 is an end elevational view of the carton, such as when viewed from the left or right in FIG. 2.
Figure 6:
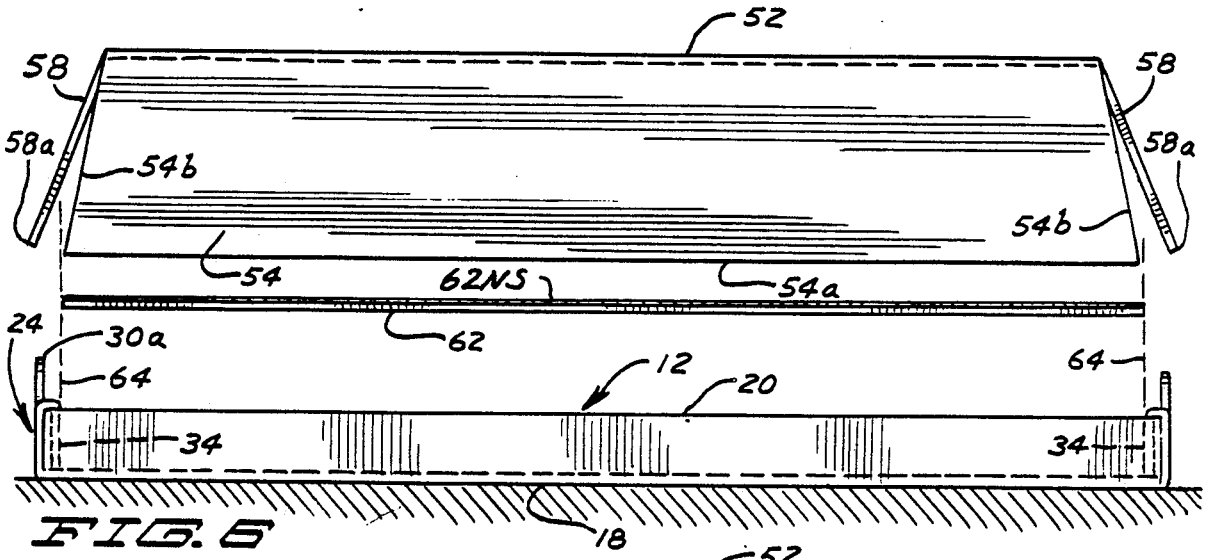
FIG. 6 is an exploded side elevational view with the cover being lowered into an interfitting engagement with the underlying tray, there being a non-skid paper doily therebetween which rests on the bottom of the tray during use.

The salient purpose of the lines 64, 66 is to portray the natural angulation of the side wall panels 54 (see FIG. 7) and the end wall panels 58 (see FIG. 6). When inserting the cover 14 into the tray 12 after food items (not shown) have been placed on the doily 62 which covers the bottom panel 18, the person who is interfitting the cover 14 with the tray 12 gently flexes the side wall panels 54 and the end wall panels 58 inwardly so that they will be telescopically received within the cavity formed by the tray 12. What is not readily discernible is that the end wall panels 58 are dimensioned so that the edges **58*b* thereof fit between the end portions of the side wall panels 54 adjacent their edges 54*b*. This can be understood from a close inspection of FIG. 3. Such an interfitting relationship between the panels 52 and 58 increases the pressural action of the side wall panels 54, more specifically their free edges 54*a*, against the side wall panels 20 where they join the bottom panel 18 of the tray 12**.

It has already been explained that the direction of the corrugations **50*c* is important, actually running from the left side to the right side of the blank 50 as viewed in FIG. 5. Stated somewhat differently, the corrugations 50*c* run lengthwise of the cover 14. Thus, the fold lines 60 extend transversely with respect to the direction in which the corrugations 50*c* extend. Hence, when the end wall panels 58 are flexed along the fold lines 60, there is a greater amount of deflective resistance or bias that results in more friction being transmitted from the end wall panels 58 against the end wall panels 24, more specifically where the end wall panels 24 are joined to the bottom panel 18 of the tray 12**.

On the other hand, since the weakened fold lines 22 extend parallel to the corrugations **50*d*, there is not as much deflective resistance imparted to the side wall panels 54 as imparted to the end wall panels 58. Hence, by having the end wall panels 58 fit between the ends of the side wall panels 54, the end wall panels 58 exert a mild amount of force against the side wall panels 54, thereby urging or biasing the side wall panels 54, more specifically their edges 54*b*, against the side wall panels 20 belonging to the tray 12**.

Figure 10:
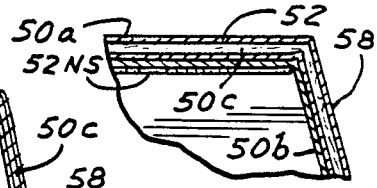
FIG. 10 is a sectional detail depicting how the corrugated construction of the cover is made use of in providing a frictional engagement with the tray, although the tray does not appear in this view.

While it is believed that the foregoing explanation is sufficient to provide an appreciation that the end wall panels 58 of the cover 14 are capable of exerting a greater amount of frictional force against the end wall panels 24, as compared with the force that the side wall panels 54 can transmit against the side wall panels 20, it might help at this point to look at FIG. 10 where the downward flexing of the portion of the end wall panel 58 appearing in this view with respect to the portion of the top panel 52 shows the bending of the particular corrugation **50*c* there appearing, the bending being transversely of the corrugation 50*c* with a concomitant greater resistance to flexing as compared with a bending or flexing of the side wall panels 54 along the fold lines 56, and hence in the direction of the corrugations 50*c***.

Figure 8:
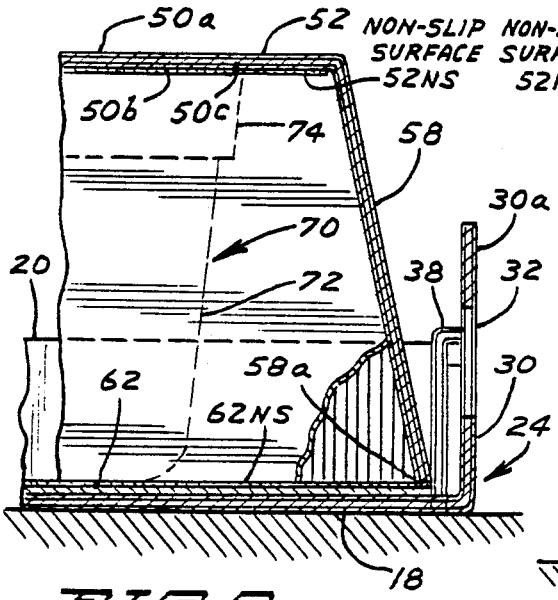
FIG. 8 is an enlarged sectional detail taken in the direction of 8—8 of FIG. 3 for the purpose of illustrating how readily one of the integral end handles can be grasped when lifting the combined tray and cover, the view additionally illustrating the frictional fit of the cover within the tray and a portion of a phantomly depicted container.
Figure 9:
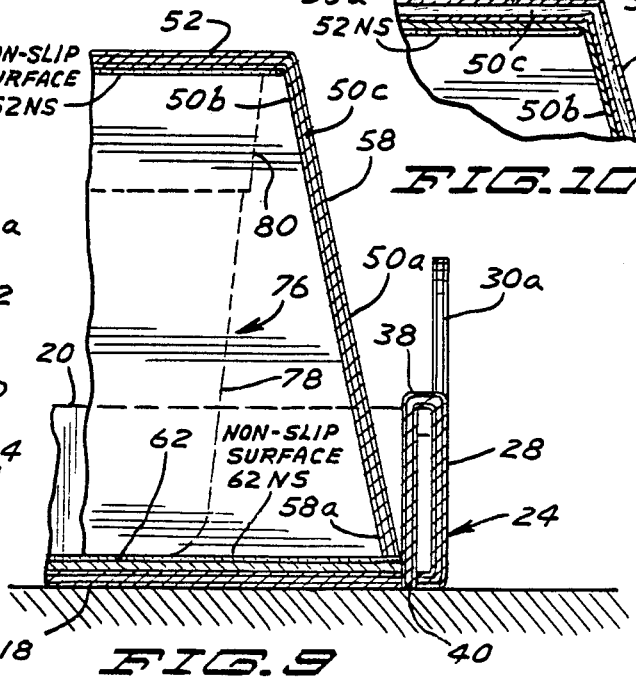
FIG. 9 is a sectional view much like that of FIG. 8 but taken in the direction of line 9—9 of FIG. 3 with a portion of another phantomly depicted container.

As best understood from FIG. 8, the central portion 30 of the end wall panel 24 resides in a vertical plane, whereas the end wall panel 58 belonging to the cover 14 extends or diverges at an angle with respect to the vertical plane in which the central portion 30 resides. Since the hand hole 32 is formed in the central portion 30, it follows that the combined tray 12 and cover 14 can be picked up far more readily because all that the delivery person need do is to insert his or her fingers through the hole 32 at each end of the combined tray and cover, the divergence appearing in FIG. 8 providing an adequate amount of space so that the person's fingers can be curved upwardly after passing through the holes 32. In other words, a firm grasp of the portion **30*a* can be effected by reason of the space provided between the central portion 30 and the end wall panel 58. FIG. 9 illustrates this advantage, too, but FIG. 9 has the more specific advantage of illustrating how the tab portions 40 are fitted into the slots 42** in each instance.

For the sake of completeness a portion of a phantomly depicted container 70 having a body 72 and a lid 74 have been shown in FIG. 8. Similarly, in FIG. 9 a portion of a second container 76 appears, having a body 78 and a lid 80. It should be appreciated that by properly dimensioning the height of the containers 70 and 76, the upper surfaces of their lids 74 and 80 will bear against the non-slip surface 52NS in addition to having the bottoms of the container bodies 72 and 78 rest on the non-slip surface 62NS. The formulation of the coating material constituting the surfaces 52NS and 62NS is not important as long as the composition is nonsetting. The employment of a sufficient amount of diluent is planned so that the coating material can be readily sprayed onto the panel 52 and the mat or doily 62. Only a slight degree of tackiness is needed, particularly where the containers 70 and 76 are dimensioned so as to engage both surfaces 52NS and 62NS.

Figure 7:
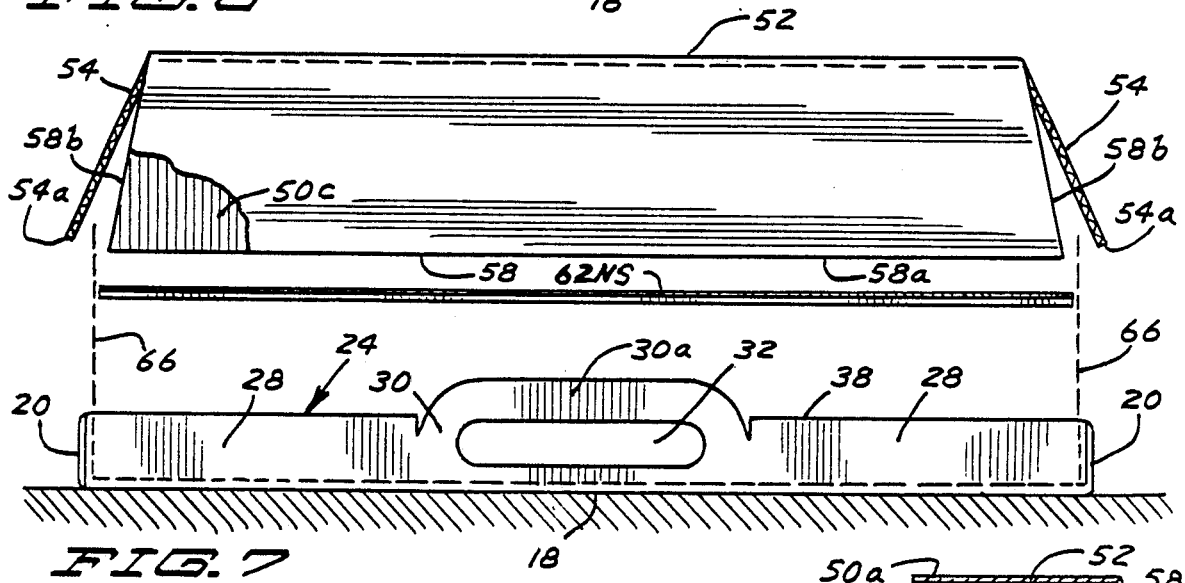
FIG. 7 is an exploded view similar to FIG. 6 but taken from one end.

From the foregoing, it should be readily apparent that, once the tray 12 has been assembled in its three-dimensional form, the cover 14 can be easily lowered into engagement with the tray 12 by simply pressing the panels 54 and 58 inwardly or toward each other, as is believed evident from FIGS. 6 and 7. Close inspection of FIG. 3 will reveal that the end wall panels 58 fit between the side wall panels 54, thereby supplying an additional amount of pressural action that more firmly retains the cover 14 in frictional engagement with the tray 12. Such retentive force is easily overcome when the customer wishes to remove the cover in order to gain access to the food items contained in the carton comprised of the tray 12 and the cover 14; all that the person need do is gently lift the cover 14 and the food items become immediately available. The cover 14 can then be discarded and later the tray 12 as well.

What is claimed:

1. A carton comprising a tray including a rectangular bottom panel, upstanding side wall panels and upstanding end wall panels, and a cover including a rectangular top panel of smaller size than said bottom panel, depending side wall panels and depending end wall panels, the cover's side wall panels sloping upwardly and inwardly and each having a straight free edge extending from end to end of the respective end wall panel and frictionally engaged throughout their length with the tray's side wall panels adjacent the tray's bottom panel and the cover's end wall panels slopingly upwardly and inwardly and each having a straight free frictionally engaged throughout their length with the tray's end wall panels adjacent the tray's bottom panel.

2. A carton in accordance with claim 1 in which the cover's side wall panels are trapezoidal and the cover's end wall panels are also trapezoidal.

3. A carton in accordance with claim 2 in which each of the side wall panels and end wall panels of said cover are hingedly connected to said top panel.

4. A carton in accordance with claim 3, in which the hinged connection of each of said side wall panels and each of said end wall panels is provided by weakened fold lines.

5. A carton in accordance with claim 4, in which said cover is fabricated from resilient paperboard so that its side wall panels are biased into an outwardly divergent relation with each other and its said end wall panels are also biased into an outwardly divergent relation with each other.

6. A carton in accordance with claim 1 in which said cover is fabricated from corrugated paperboard and the corrugations of said paperboard extend longitudinally in the direction of the end wall panels of said cover and continue perpendicularly from the weakened fold lines of said end wall panels to the free edges thereof to impart a greater degree of deflective resistance to the end wall panels of said cover as compared with the degree of deflective resistance imparted to the side wall panels of said cover.

7. A carton in accordance with claim 6 in which the side wall panels of said cover have end edges that diverge from the weakened fold lines of said side wall panels and the end wall panels of said cover have end edges that also diverge from the fold lines of the end wall panels of said cover.

8. A carton in accordance with claim 7 in which the end edges of the end wall panels of said cover fit between the side wall panels of said cover to provide a biasing action of the side wall panels of said cover against the side walls of said tray.

9. A carton comprising a tray including a rectangular bottom panel, upstanding side wall panels and upstanding end wall panels, and a cover including a rectangular top panel, depending side wall panels and depending end wall panels, the cover's side wall panels having free edges frictionally engageable with the tray's side wall panels and the cover's end wall panels having free edges frictionally engageable with the tray's end wall panels, and a doily overlying said bottom panel, said doily having a non-slip coated upper surface providing a slight degree of tackiness.

10. A carton in accordance with claim 9 in which the side of said top panel facing toward said bottom panel also has a non-slip surface.

11. A carton in accordance with claim 10 including at least one container dimensioned so as to engage both of said non-slip surfaces.

12. A carton comprising a tray including a rectangular bottom panel, upstanding side wall panels and upstanding end wall panels, and a cover including a rectangular top panel, depending side wall panels and depending end wall panels, the cover's side wall panels having free edges frictionally engageable with the tray's side wall panels and the cover's end wall panels having free edges frictionally engageable with the tray's end wall panels, said cover being fabricated from corrugated paperboard and having the corrugations thereof extending longitudinally in the direction of the end wall panels of said cover and continuing perpendicularly from the weakened fold lines of said end wall panels to the free edges thereof to impart a greater degree of deflective resistance to the end wall panels of said cover as compared with the degree of deflective resistance imparted to the side wall panels of said cover, said side wall panels of said cover having end edges that diverge from the weakened fold lines of said side wall panels and the end wall panels of said cover having end edges that also diverge from the fold lines of the end wall panels of said cover, the end edges of the end wall panels of said cover fitting between the side wall panels of said cover to provide a biasing action of the side wall panels of said cover against the side walls of said tray, the end wall panels of said tray extending perpendicularly and upwardly from said bottom panel, the end wall panels of said cover inclining upwardly and away from the end wall panels of said tray, and the end wall panels of said tray having lifting holes therein.

* * * * *

UNITED STATES PATENT AND TRADEMARK OFFICE

CERTIFICATE OF CORRECTION

PATENT NO. : 4,801,077

DATED : January 31, 1989

INVENTOR(S) : Blaine Sweatt III & Stephen E. Moorman

It is certified that error appears in the above-identified patent and that said Letters Patent is hereby corrected as shown below:

Col. 1, line 63; "destine" should be --- destined ---.

Col. 3, line 2; "blan" should be --- blank ---.

Col. 3, line 58; "portion 2" should be --- portion 28 ---.

Col. 4, line 26; "5" should be --- 50 ---. (first occurrence)

Col. 4, line 45; "56 It" should be --- 56. It ---.

Col. 4, line 56; "panel 1" should be --- panel 18 ---.

Col. 4, line 68; "lines 66" should be --- lines 66. ---.

Col. 6, line 52; "end wall" should be --- side wall ---.

Col. 6, line 56; after "free" insert --- edge extending from end to end of the respective end wall panel and ---.

Signed and Sealed this

Twelfth Day of September, 1989

*Attest:*

DONALD J. QUIGG

*Attesting Officer*

*Commissioner of Patents and Trademarks*